United States Patent [19]

Nagley

[11] 4,329,799

[45] May 18, 1982

[54] TYPING COPY STAND

[76] Inventor: Bruce K. Nagley, 4765 Kingshill Dr., Columbus, Ohio 43229

[21] Appl. No.: 121,637

[22] Filed: Feb. 14, 1980

[51] Int. Cl.[3] ..... B41J 11/64

[52] U.S. Cl. ..... 40/352; 40/110

[58] Field of Search ..... 40/352, 110; 35/35 B; 235/70 B; 116/240

[56] References Cited

U.S. PATENT DOCUMENTS

| | | | |
|---|---|---|---|
| 1,069,859 | 8/1913 | Dahlberg | 40/352 |
| 1,607,544 | 11/1926 | McCready | 40/352 |
| 2,322,261 | 6/1943 | Thurston | 40/352 |
| 2,981,231 | 4/1961 | Howard | 40/352 |
| 3,129,695 | 4/1954 | Adelman | 40/352 |
| 3,153,400 | 10/1964 | Mendels | 40/352 |
| 4,024,662 | 5/1977 | Krulwich | 40/352 |

FOREIGN PATENT DOCUMENTS

| | | | |
|---|---|---|---|
| 321573 | 11/1929 | United Kingdom | 40/110 |
| 533392 | 2/1941 | United Kingdom | 40/110 |

*Primary Examiner*—Gene Mancene
*Assistant Examiner*—Wenceslao J. Contreras
*Attorney, Agent, or Firm*—Robert E. Stebens

[57] ABSTRACT

A typing copy stand is provided for use in conjunction with a typewriter. This typing copy stand comprises a support plate having a pair of vertically extending and spaced apart slots for cooperative engagement with a guideline bar. The guideline bar has flanges which project through the slots and are connected to one another by a tension spring to bias the flanges into frictional engagement with the sides of the slots. The bar may be frictionally retained at a desired position but is easily and readily moved to a selected position. One embodiment has the copy support disposed in upwardly inclined relationship and may also incorporate a hook support ledge. Another embodiment of the typing copy stand has the support plate disposed perpendicular to a support base and in elevated relationship so as to be above a typewriter. A paper support strip may be attached to the copy support plate below and extending transversely to the vertically extending slots.

8 Claims, 5 Drawing Figures

TYPING COPY STAND

BACKGROUND OF THE INVENTION

This invention is directed to the providing of a suitable typing copy stand which is designed to be utilized by a typist to hold the sheets of material to be copied. The typing copy stand of this invention is intended as a supplementary structure positionable adjacent a typewriter for holding the copy at an optimum position for increasing the speed and accuracy of the typist while at the same time helping to decrease operator fatigue and eye strain. A selectively movable line guide is also provided to aid in attainment of these objectives.

Several types of copy holder structures are known with examples being shown in previously issued U.S. Pat. Nos. 598,689; 801,468; 1,130,559; 2,146,465; 2,274,888; 2,505,814 and 2,807,908. The structure shown in U.S. Pat. No. 801,468 must be physically secured to the table by mechanical means to maintain it in an upright position and includes a rubber or elastic band intended to function as a line indicating device. Positioning of that patented device is limited thus reducing its ability to hold the copy a position preferred by the typist and the encircling elastic band is difficult to move to a desired position. U.S. Pat. No. 2,807,908 illustrates a relatively bulky structure that is more effectively utilized as a reading stand and not a typing copy holder but it does show a device that can be used for indicating line position. Again, the line indicating device is extremely difficult to position and is of the basic encircling elastic band structure although the actual component thereof that functions as the line indicator is a rigid bar. Also, the center support post prevents movement of the bar over the full area of the copy.

Each of U.S. Pat. Nos. 1,130,559; 2,146,465 and 2,274,888 illustrate copy holders which are designed to be mounted on a typewriter or secured in position by the typewriter and are provided various styles of line indicating devices. These illustrated line indicating devices clamp to the copy support plate or frame and, except for that shown in U.S. Pat. No. 2,274,888, require two hands for operation and displacement to a selected line position. Such devices are difficult to use and are not desired by typists. U.S. Pat. No. 2,146,465 describes, but does not illustrate, an alternative line guide that may only require one-hand operation although the described structure has a screw fastener that is difficult to operate. While the device shown in U.S. Pat. No. 1,130,559 does not utilize the difficult to operate screw type clamps, it does require two hands for operation in effecting movement of the sliders at each side. U.S. Pat. No. 2,274,888 shows a spring type clamp mechanism for securing the line guide in a desired position and such a mechanism is difficult to operate.

The other two previously issued U.S. Pat. Nos. 598,689 and 2,505,814 do illustrate copy holders with line guides but are deemed relevant as showing background art in this field. U.S. Pat. No. 2,505,814 is particularly considered relevant in that it shows a copy holder that is positioned directly in back of the typewriter and supports the copy above the typewriter.

In general, the known typing copy holders have not been found to be satisfactory as a consequence of their difficult to operate structures. Line guides of the manual type that have been heretofore provided on copy holders are cumbersome to operate requiring substantial effort to displace the line guide and involve time consuming operations. The structures are such that use of the previously patented copy holder structures and their line guides actually results in a decrease in efficiency and, consequently, are not desired for use by typists.

SUMMARY OF THE INVENTION

In accordance with this invention, a typing copy stand is provided for advantageous use in conjunction with a typewriter when used in association therewith. The typing copy stand structure of this invention is formed from a sheet of relatively rigid plastic material such as clear or transparent plastics that can be fabricated in a thickness suitable for attaining the necessary structural strength while continuing to be light in weight. In accordance with one embodiment of this invention, a copy support plate for the sheets of copy material is formed having a pair of vertically extending and spaced apart slots for cooperative engagement with a bar that functions primarily as a line guide. Additionally, one preferred embodiment of this typing copy stand features a book support ledge and a support base formed by a pair of triangularly shaped support plates integrally formed with the copy support plate and maintains it at a rearwardly inclined position.

Included in the embodiments of the invention is a guideline bar that may also be formed from a suitable plastic material and which has a degree of flexibility and is formed with flanges that project through the vertically extending slots in the copy support plate. A tension spring is attached to the opposite flanges on the rear side of the inclined copy support plate.

A second embodiment of a typing copy stand embodying this invention features an upright copy support plate which is disposed perpendicular to a plate-like support base. This upright copy support plate also has a pair of vertically extending and spaced apart slots for cooperative engagement with a guideline bar. The guideline bar assembly associated with the modified typing copy stand is the same as the one associated with the first embodiment. However, the modified structure includes a paper support strip in the place of the book support ledge. Additionally, the modified stand has a small opening near the bottom of the upright copy support plate through which an electric cord may pass. A typewriter is designed to rest upon the support base with its cord extending through the small opening with the weight of the typewriter serving to maintain the copy stand in an upright position.

In both embodiments of the typing copy stand, the sheet of paper having the material to be copied rests in coplanar relationship with the surface plate and may be securely held in this relationship by means of a conventional clamping device which may be removably attached to the upper edge of the surface plate. The guideline bar may be slideably moved vertically along the elongated slots with the tension spring providing an adequate holding force for the end flanges to frictionally grip the edges of those slots which are formed in the copy support plate.

The primary objective of this invention is to provide a typing copy stand that is extremely easy to use and easy to maintain in a functional operative relationship to a typewriter. This important objective is furthered by the formation of a typing copy stand having only one slideably moving part with manipulation of this part being able to be easily effected by one hand. Another important aspect of this objective is the fact that the typing copy stand is formed from an extremely lightweight material and is designed such that it can be selectively positioned with relationship to the typewriter in accordance with the desires of the typist.

Another objective of this invention is to provide a typing copy stand which acts as an aid to the speed of the typist as a result of its unique and novel construction. An important aspect of this invention is the line guide bar which helps eliminate errors such as line mixing while increasing the speed and accuracy of the typist.

Still another objective of this invention is to provide a typing copy stand that is of extremely economical construction and is relatively easy to fabricate. An important aspect of this objective is the providing of an extremely advantageous typing copy stand at a low cost.

Another objective of this invention is to provide a typing copy stand which, because of its construction, results in the reduction of typist fatigue. Important aspects of this objective are the moveable nature of the typing copy stand and the relative ease with which it may be used by the typist. Also, the presence of the guideline bar helps to eliminate eye strain while also insuring that the page desired to be copied remains in a fixed position.

These and other objects and advantages of this invention will be readily apparent from the following detailed description of an illustrative embodiment thereof. Reference will be had to the accompanying drawings which illustrate the embodiment of the invention.

DESCRIPTION OF THE DRAWING FIGURES

DESCRIPTION OF THE ILLUSTRATIVE EMBODIMENT

Figure 1:
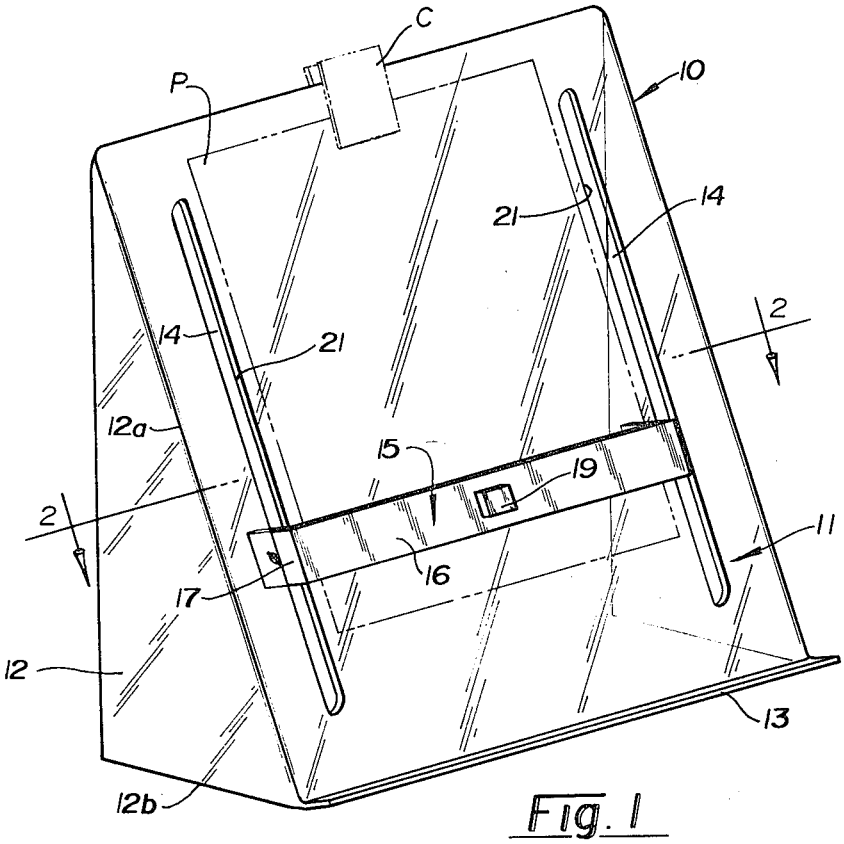
FIG. 1 is a front perspective view of a typing copy stand embodying my new invention.

Having reference to the drawings, attention is directed first to FIG. 1 which illustrates a typing copy stand embodying this invention designated generally by the numeral 10. The typing copy stand structure of this invention includes as a basic component thereof, a sheet of fairly rigid plastic which has been fabricated into the typing copy stand 10 shown in FIG. 1. The typing copy stand 10 is advantageously fabricated from a a suitable plastic such as an acrylic type exhibiting the necessary structural strength characteristics. The typing copy stand 10, as shown, is approximately 15 inches in height and 12 inches in width with the plastic sheet thickness being of the order of three-sixteenths inch. Additionally, the plastic sheet material is preferably clear or translucent and may have a smoked or metallic tint for enhancement of its appearance so as to be aesthetically pleasing.

In accordance with this invention, the typing copy stand 10 features an inclined surface, copy support plate 11 which functions to support a sheet of copy material at an optimum angle. This rectangular copy support plate 11 has as its support base a pair of support plates or flanges 12. The flanges 12 are of a triangular configuration with each hypotenuse edge 12*a* of the support flange 12 co-extensive with the vertically extending respective side edges of the inclined support plate 11 and the base or bottom edge 12*b* adapted to rest on a desk top and hold the copy support plate at an inclination of about seventy-five degrees. The support flanges 12 are preferably integrally formed from the same plastic sheet as the inclined support plate 11, but it is to be understood that the support plate and flanges could be fabricated from another type of plastic material or other material as separate components that are then assembled and fastened together by suitable means to form a rigid structure. Alternatively, the flanges may be hinged to the copy support plate.

The typing copy stand 10 also features a book support ledge 13 which projects outwardly and upwardly from the lower edge of the inclined surface place 11. This book support ledge 13 is of a suitable depth, such as one inch, to adequately accommodate an average size text book. This book support ledge 13 in the preferred embodiment also is integrally formed from the same molded sheet of plastic as the support flange 12 and copy support plate 11.

An extremely important component of this typing copy stand 10 is the pair of vertically extending and spaced apart slots 14 which cooperatively engage with a guideline bar 15. These slots 14 are located approximately one inch in from the edges of the inclined surface plate 11, thus providing enough room between them for the insertion of a sheet of paper or other work to be copied and are most desireably formed in accurate parallel relationship. The slots also extend vertically approximately twelve inches to allow the guideline bar 15 which functions as a copy line guide to be able to completely scan a regular size piece of paper. For purposes of illustration, a sheet of paper P is shown in broken lines as it would be positioned and held by a clip C also shown in broken lines.

Figure 3:
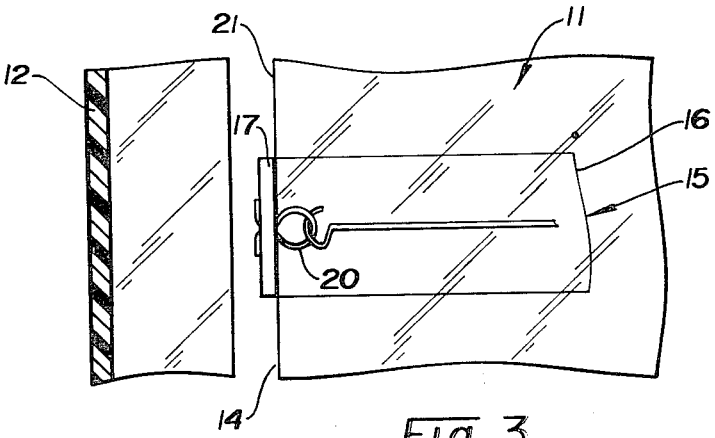
FIG. 3 is a fragmentary vertical sectional view on an enlarged scale taken along line 3—3 of FIG. 2.
Figure 2:
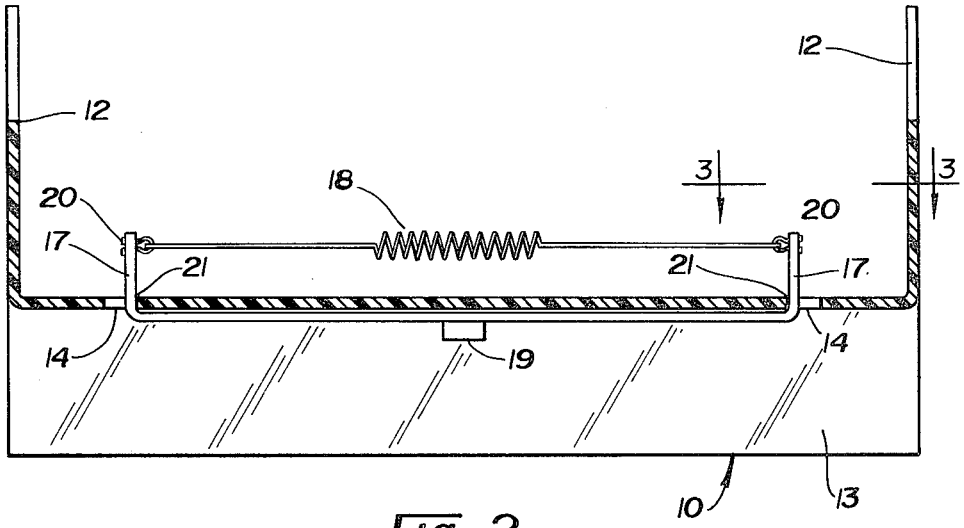
FIG. 2 is a horizontal sectional view on an enlarged scale taken along line 2—2 of FIG. 1.

This guideline bar 15 is comprised of three major components, namely, a line guide 16, end flanges 17 and a tension spring 18. The line guide 16 and end flanges 17 are integrally formed from a resilient material, thus having a degree of flexibility, which is in strip form about one and one-half inches wide and one-eighth inch thick. It will be noted that the slots 14 are of a width sufficiently greater than the thickness of the flanges 17 to prevent binding. The width dimension is important to minimizing any tendency of the line guide to rock about its longitudinal axis or to become skewed with respect to the slots 14. A knob 19 is located on the outer central portion of the line guide 16 to assist in the movement of the guideline bar and facilitate its utilization. The end flanges 17 are perpendicularly oriented to the line guide 16 to project rearwardly through the slots 14. Securing of the guideline bar 15 at a desired vertical position on the copy support plate 11 is achieved by means of the tension spring 18. As best seen in FIGS. 2 and 3, the spring 18 is secured at each end to the end flanges 17 by respective clips 20 and thus pulls those flanges toward each other. The tension of the spring with a proper length dimension of the line guide 16 with respect to the spacing of the slots 14 is sufficient to cause the inner surfaces of the end flanges to grip the side edge 21 of the respective slots. The frictional interengagement is adjusted to provide optimum operation and is attained when the guideline bar 15 will remain in any position to which it is moved but requires very little force to effect displacement. The amount of tension force provided by the spring 18 may be adjusted by stretching this spring, thus decreasing the tension and resulting holding force and force required for displacement of the bar. Also, a silicon spray type lubrication may be applied on the slot edges 21 and the inside surfaces of the end flanges 17 to initially reduce friction. However, after the edge surfaces mate or wear in, the lubricant need not be reapplied.

Functional operation of the typing copy stand 10 is illustrated in FIG. 1 by the utilization of the clamp C and a sheet of paper P. The sheet of paper P is positioned in coplanar relationship to the inclined copy support plate 11 and then held by the clamp C which may be of any conventional style or design and clamped to the upper edge of the inclined copy support plate. The lower portion of the paper is placed such that it lies between the copy line guide 16 and the surface of the copy support plate. Movement of the copy guide line bar 15 to aid in following the lines of the paper P is readily accomplished by merely pushing inwardly and downwardly on the knob 19 with a force F as shown in FIG. 2. Application of only a very slight force will be sufficient to overcome the frictional gripping force previously applied by the spring 18 in association with the end flanges 17 to the side edges 21 of the slots 14. Very little force is required to move the copy line guide 15 upwardly or downwardly. Additionally, the clamping force provided by the spring 18 is enough to cause a slight outward flexing of the line guide 16 with respect to the surface of the copy support plate 12 so that the paper P may be easily removed from the typing copy stand 10 by first detaching the clamp C and then sliding the paper P out from under the line guide.

This particular style of the typing copy stand may be used on either side of a typewriter and may be selectively positioned by the typist such that a minimal amount of turning of the head is required. Additionally, the angle associated with the inclined surface plate 11 and the relative height of the paper P permits easy copying of the sheet and thus serves to lessen eye strain and muscle fatigue. Also, a piece of paper may be removed or inserted without consideration as to the position or location of the line guide, thus, simplifying the task when compared with other known models of typing copy stands. The ease and speed associated with the use of this typing copy stand thus results in increased worker efficiency.

Figure 5:
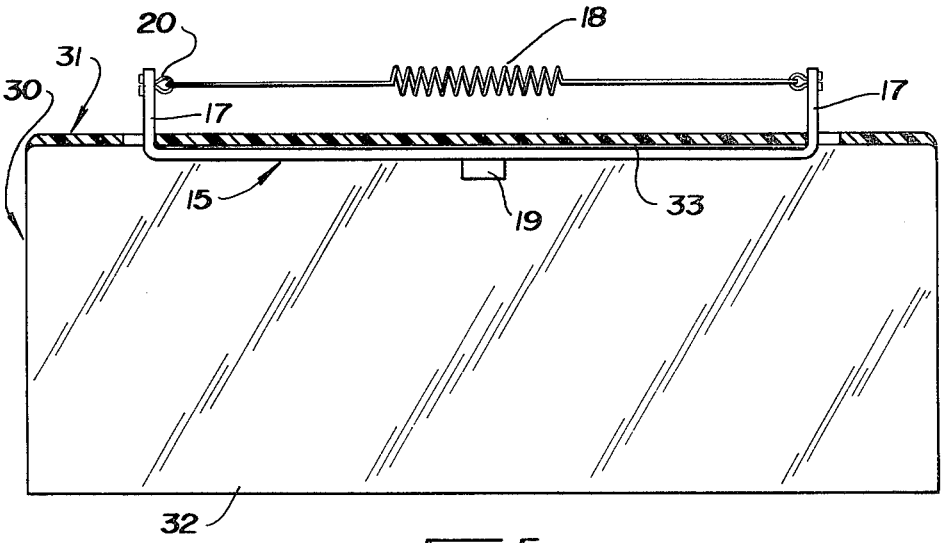
FIG. 5 is a horizontal sectional view on an enlarged scale taken along line 5—5 of FIG. 4.
Figure 4:
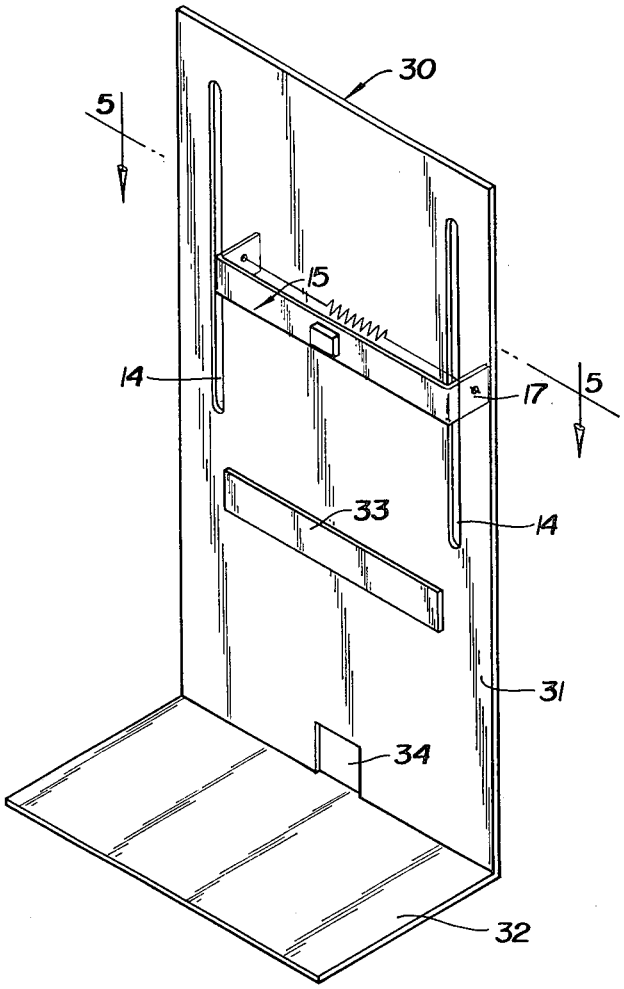
FIG. 4 is a front perspective view of a second embodiment of a typing copy stand embodying my new invention.

A second embodiment of the invention is illustrated in FIGS. 4 and 5. This modification comprises a change in the style of the base support to allow this type of stand 30 to be accommodated directly behind a typewriter. In this embodiment the copy support plate 31 of this modified typing copy stand 30 is of a vertical height so as to hold the copy sheet above the top of the typewriter. This upright plate 31 is at preferably a 90° angle to the typewriter desk (not shown) and is integrally formed with a plate 32 which serves as the unit's support base. The 90° angle allows the modified typing copy stand 30 to project vertically upwards at the back of the typewriter which may be located directly upon the base plate 32 to assure that the stand will be maintained in a fixed position.

This modified typing copy stand 30 incorporates the same structural features associated with the guideline bar of the first described typing copy stand 10. Accordingly, no further description of those components is necessary except to note use of the same numeral for the same components. The modified stand 30 does not have a book support ledge, but instead, incorporates a paper support ledge in the form of a strip 33 of plastic secured to the front surface. This paper support strip is approximately one and one-fourth inches high and one-eighth inch thick and is located at such a height on the copy support plate 31 so that the bottom sheet of paper will be clearly visible above the top of a typewriter when the modified typing copy stand is in use. This modified typing copy stand 30 would preferably be approximately 23 inches high and twelve inches wide with the paper support strip 33 located approximately eight inches above the base plate 32. The base plate 32 itself is approximately seven inches deep to provide an adequate support base for the modified typing copy stand 30. Additionally, an electric power cord opening 34 is provided at the bottom of the upright plate 31 through which the typewriter cord and plug may be passed.

Functional operation of the modified typing copy stand 30 occurs in much the same way as it does for the typing copy stand 10 in that a piece of paper is placed between the line guide 16 and the upright copy support plate 31. Additionally, a clamp may be used to secure the paper to the upper edge of the upright surface plate. The lower edge of the paper may rest on the paper support strip 33. Movement of the line guide 16 would be accomplished in the same advantageous manner.

It will be readily apparent from the foregoing detailed description of illustrative embodiments of this invention that a particularly novel and extremely effective typing copy stand is provided. This typing copy stand is relatively simple to fabricate and requires a minimal amount of time to secure a piece of paper desired to be copied. The structure utilizing a fairly rigid plastic sheet as the basic structural element thereof is economical to fabricate and results in an extremely aesthetically appealing typing copy stand. The specific configuration of the line guide bar and tension spring in cooperation with the slots results in a typing copy stand which is extremely advantageous and useful to typists. It will also be understood that the specific dimensional configurations disclosed are exemplary and that a copy stand embodying the principles of this invention can be otherwise dimensioned and utilized with printed materials other than typing copy. For example, a stand having the configuration of the free standing embodiment may be readily adapted to support electronic data processing forms which are dimensionally larger, particularly in a horizontal direction.

Having thus described this invention, what is claimed is:

1. A typing copy stand comprising a copy support plate having a front copy support surface on which a copy sheet is adapted to be retained in coplanar relationship, a rear surface and a pair of spaced parallel, elongated edge surfaces formed therewith in vertically extending relationship and spaced apart a distance to permit positioning of a sheet of paper therebetween, a support base for holding said copy support plate in upstanding relationship to a horizontal supporting surface, and a copy guide line bar including an elongated line guide positioned in overlying relationship to the front surface of said copy support plate and of a length substantially equal to the spacing of said edge surfaces, said line guide being formed from a flat strip of resiliently flexible material capable of flexing only in a direction perpendicular to the plane of said copy support plate and having affixed thereto at each respective end thereof an end flange which projects laterally with respect thereto and extends across respective ones of said edge surfaces terminating a distance rearwardly of the rear surface of said copy support plate and being longitudinally displaceable along said edge surfaces, and resilient force applying means interconnected with portions of said end flanges projecting rearwardly of the rear surface of said copy support plate for biasing of said flanges toward each other and effecting frictional gripping engagement with said edge surfaces whereby biasing forces exerted on said flanges by said resilient force applying means causes flexing of said line guide outwardly with respect to said front copy support surface and are counterbalanced by resilient forces developed by the flexing of said line guide.

2. A typing copy stand according to claim 1 wherein said force applying means is interconnected between said end flanges.

3. A typing copy stand according to claim 1 wherein said force applying means comprises a tension spring mechanically coupled between said end flanges.

4. A typing copy stand according to claim 1 wherein said elongated line guide and end flanges are integrally formed from a strip of material of predetermined width that provides stability in the sliding movement thereof along said edge surfaces.

5. A typing copy stand according to claim 1 wherein said support base is adapted to be disposed in supported relationship on a horizontal support surface and comprises a base plate secured in fixed relationship to said copy support plate at the bottom thereof in forwardly projecting relationship, said base plate projecting a distance forwardly to underlie a typewriter in retained relationship therewith, and said copy support plate is of a vertical length such that the copy support surface is supported at an elevation to be substantially above a typewriter disposed in overlying relationship to said base plate, said copy support plate having formed therein a pair of spaced parallel, elongated slots extending vertically at opposite sides of said plate with each slot disposed a predetermined distance inwardly of a respective vertical side edge of said plate, said elongated edge surfaces each being a side edge of a respective slot with each line guide end flange projecting through a respective slot.

6. A typing copy stand according to claim 5 wherein said copy support plate includes a copy paper support ledge positioned on the copy support surface in fixed relationship and projecting a distance outwardly therefrom, said ledge positioned at an elevation substantially equal to the top of a typewriter with the bottom end of said slots terminating at substantially the same elevation.

7. A typing copy stand according to claim 1 wherein said copy support plate includes a pair of spaced parallel, elongated slots formed therein in vertically extending relationship with each of said elongated edge surfaces being a side edge of a respective slot, each of said slots being formed a distance laterally inward of a respective vertical side edge of said copy support plate with said line guide being of a length such that the end flanges thereof each project through a respective one of said slots, and said support base includes a pair of vertically disposed support flanges with each flange secured to said copy support plate in rearwardly projecting relationship to the copy support surface at opposite vertical sides of said plate and disposed a distance relatively outward of a respective one of said slots to provide clearance for passage thereby of a line guide end flange, each of said support flanges having a bottom edge surface for supporting engagement with a horizontal support surface to support said copy support plate surface in an upwardly and rearwardly inclined relationship.

8. A typing copy stand comprising a copy support plate having a front copy support surface on which a copy sheet is adapted to be retained in coplanar relationship, a rear surface and a pair of spaced parallel, elongated slots formed therein in vertically extending relationship with each slot disposed a distance laterally inward of a respective vertical side edge of said copy support plate, said slots each having adjacent inwardy disposed side edges forming a pair of spaced parallel, elongated edge surfaces disposed in vertically extending relationship and spaced apart a distance to permit positioning of a sheet of paper therebetween, a support base for holding said copy support plate in upstanding relationship to a horizontal supporting surface, and a copy guide line bar including an elongated line guide positioned in overlying relationship to the front surface of said copy support plate and of a length substantially equal to the spacing of said slot edge surfaces, said line guide being formed from a flat strip of resiliently flexible material capable of flexing only in a direction perpendicular to the plane of said copy support plate and having affixed thereto at each respective end thereof an end flange which projects laterally with respect thereto through a respective slot and extends across respective ones of said edge surfaces terminating a distance rearwardly of the rear surface of said copy support plate and being longitudinally displaceable along said edge surfaces, and resilient force applying means interconnected with said end flanges for biasing of said flanges toward each other into frictional gripping engagement with said edge surfaces whereby biasing forces exerted on said flanges by said resilient force applying means causes flexing of said line guide outwardly with respect to said front copy support surface and are counterbalanced by resilient forces developed by the flexing of said line guide.

* * * * *